US006612518B2

(12) United States Patent
Nordlof

(10) Patent No.: US 6,612,518 B2
(45) Date of Patent: Sep. 2, 2003

(54) SPACE-SAVING REEL FOR STRIP-STOCK

(75) Inventor: Richard D. Nordlof, Rockford, IL (US)

(73) Assignee: Mechanical Tool & Engineering Co., Rockford, IL (US)

( * ) Notice: Subject to any disclaimer, the term of this patent is extended or adjusted under 35 U.S.C. 154(b) by 46 days.

(21) Appl. No.: 10/005,654

(22) Filed: Dec. 3, 2001

(65) Prior Publication Data

US 2003/0102398 A1 Jun. 5, 2003

(51) Int. Cl.[7] ..... B65H 77/00
(52) U.S. Cl. ..... 242/417.3
(58) Field of Search ..... 242/417, 417.2, 242/417.3, 557, 564.2, 566, 615.1, 615.2

(56) References Cited

U.S. PATENT DOCUMENTS 3,608,808 A * 9/1971 Wolf et al.
3,618,870 A 11/1971 Martin
3,912,191 A * 10/1975 Anderson et al.
3,963,191 A * 6/1976 Goodley
4,153,218 A * 5/1979 Martin
4,260,116 A * 4/1981 Collin
4,447,016 A 5/1984 Enberg et al.
4,517,735 A 5/1985 Watkins
4,555,071 A 11/1985 Nordlof
4,700,907 A 10/1987 Nordlof
4,773,610 A 9/1988 Nordlof
5,123,607 A * 6/1992 Jones
5,778,507 A 7/1998 Grannan et al.
6,119,971 A 9/2000 Jones

* cited by examiner

*Primary Examiner*—William A. Rivera
(74) *Attorney, Agent, or Firm*—Keith Frantz

(57) ABSTRACT

A reel for coiled strip stock includes a coil support adapted to carry a coil of strip stock for rotation about a horizontal axis, and a pair of pivotally mounted stock guides that establish a variable-sized loop of stock substantially encircling the coil support between payoff from the coil and exiting to the using station.

14 Claims, 3 Drawing Sheets

SPACE-SAVING REEL FOR STRIP-STOCK

CROSS-REFERENCES TO RELATED APPLICATIONS none.

Reference to Microfiche Appendix not applicable.

Statement Regarding Federally Sponsored Research or Development not applicable.

BACKGROUND OF THE INVENTION

1. Field of Invention

The present invention relates generally to reels of the type suitable to payoff strip stock from a coil to a using station, and to rewind the used stock from the using station into a coil.

More particularly the invention relates to a reel that is uniquely adapted to save floor space in the feed line when used as a payoff reel, and in the exit line when used as a rewind reel, and which, while suitable for other uses, is particularly useful in supplying and receiving strip stock to and from a using station that draws and discharges the stock in incremental lengths.

2. Description of Prior Art

Many strip stock using stations, such as punch presses and associated feed mechanisms, draw and discharge stock in incremental lengths, moving the stock in step fashion therethrough to provide a dwell time during each cycle for the using station to operate on the stock.

In feeding strip stock to such using stations, it is common practice to maintain a loop of stock between the supply station and the using station in order to accommodate the intermittent transfer of stock into the using station. The loop provides a ready supply of material available to be drawn incrementally into the using station without encountering or the need to accommodate the supply station feed characteristics.

Reels are commonly used to supply strip stock from a coil of stock to the using station. Power-rotated reels typically include a dancer arm or other apparatus to control the rotation of the reel, and thus the speed of stock payoff from the reel as it turns, to maintain the loop of stock between the reel and the using station within pre-established size parameters. When strip stock is supplied from a coil on a non-powered reel, the loop of stock accommodates the difference in supply characteristics of the rotating reel and the intermittent draw of the using station, and eliminates the potential effect of coil inertia or reel drag on the availability of material to be drawn into the using station. In both instances, the loop of stock is provided to insure that stock is immediately available to the using station on demand. Similarly, rewinding the residual strip stock exiting the using station conventionally requires a loop of stock between the using station and the rewinding reel to accommodate the differences in operational characteristics.

Unfortunately, in many conventional feed line and exit line arrangements, these loops can require substantial floor space which correlates into rent, heating and other costs of operation.

Since it is desirable to reduce operational costs associated with a strip stock using station, there is an ever-present need to reduce the floor space that is necessary to accomplish the feeding and rewinding of strip stock to and from the using station. Thus, there is a need to provide the benefits achieved with the loops of stock in conventional strip stock feed and exit lines to and from the using station while reducing and preferably eliminating the floor space requirements conventionally associated therewith.

In addition, the material in a conventional loop of stock can jerk and whip around as the stock is drawn into the using station, particularly when drawn at a relatively high acceleration. This action can cause detrimental effects on the ability to precisely control the drawn stock length, and in severe instances, presents the potential for damage to the material or surrounding equipment and injury to personnel. To preclude the possibility of such damage or injury, and to assist in providing for consistent material length draw by the using station, it is desirable to provide a supply station that reduces the tendency for the material to respond adversely to the draw characteristics of the using station.

SUMMARY OF THE INVENTION

The general purpose of the present invention is to provide a reel for coiled strip stock that is adapted to smoothly payoff and rewind the stock to and from a using station with a substantially reduced floor space requirement as compared with the floor space associated with the use of conventional reels.

A detailed objective is to provide a reel that establishes a variable-size loop of stock generally encircling the coil, the size of the loop being responsive to the differences between the stock-supply characteristics of the reel and the draw characteristics of the using station, and thus eliminate the need for additional floor space that is conventionally required to establish the loop of stock between the coil and the using station.

Another detailed objective of the invention is to provide a pair of stock guides that are cooperative to guide the stock through the variable-size loop for a relatively smooth payout of stock from the loop to the using station.

A more detailed objective is to achieve the foregoing by providing a pair of stock guides that are mounted for movement toward and away from the coil, that are biased to a position away from the coil, and that are adapted to guide the strip stock in a loop around the coil to establish a variable-size loop that smoothly contracts towards and expands away from the coil in response to the differences between the stock-supply characteristics of the reel and the draw characteristics of the using station.

Another more detailed objective is to establish the variable-size loop of stock with the guiding assistance of the coil prior to exiting the reel to the using station.

Yet another more detailed objective is to provide the stock guides on tension arms that are mounted for swinging toward and away from the coil, for ease of providing guides with relatively large movement and for ease of adjustment of the biasing forces on the guides.

These and other objectives and advantages of the invention will become more apparent from the following detailed description when taken in conjunction with the accompanying drawings.

Briefly, a reel provided in accordance with a preferred embodiment includes a rotatable support adapted to carry a coil of stock, and a pair of tension arms and associated stock guide rollers that are pivotally mounted below the coil support for swinging toward and away from the coil, are resiliently-biased away from the coil, and are positioned in adjacent quadrants oppositely of the point of payoff from the coil to guide the stock in a loop around and outwardly of the coil after payoff but prior to exiting the reel. In this instance, the stock pays-off from the top of the coil on the downstream side, travels downwardly to the first roller, turns back and travels in the upstream direction under the coil and around the second roller, turns upwardly to slidably engage the outer coil of stock on the upstream side of the coil prior to the point of payoff from the coil, and then slides along the top of the coil and on to the using station. As the using station draws stock from the reel during each material draw cycle, the tension arms and rollers are drawn toward the coil and the size of the loop temporarily decreases until the reel supplies additional stock to the loop.

Figure 2:
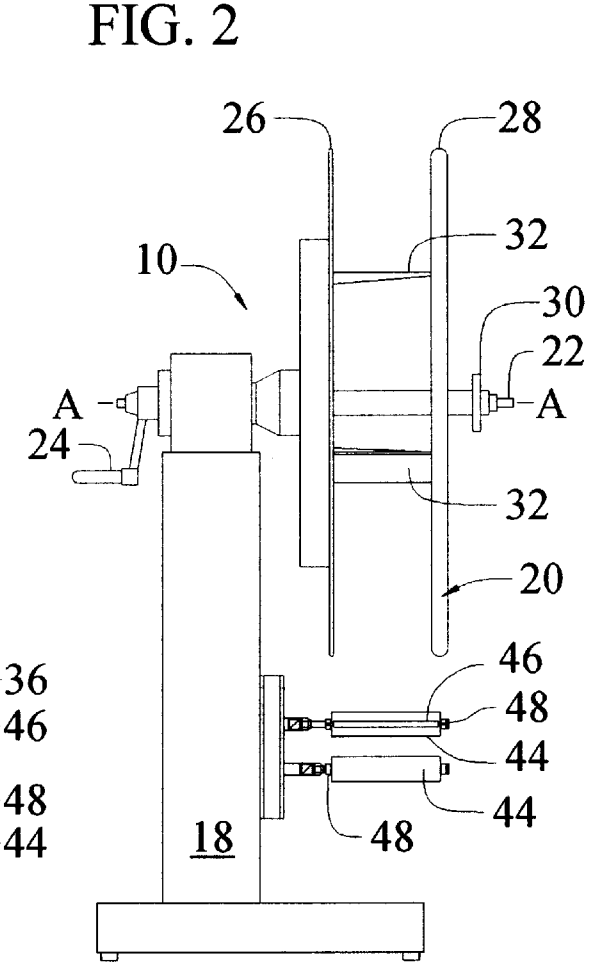
FIG. 2 is a downstream end view of the reel of FIG. 1.

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

Reference numerals shown in the drawings correspond to the following items:

10—reel
12—strip stock
14—coil
16—using station
18—frame support structure
20—coil support
22—shaft
24—handle
26—back plate of coil support
28—front ring of coil support
28*a*—hub
28*b*—ring supports
30—threaded cap of coil support
32—coil guides of coil support
34—variable-sized loop of strip stock
36—tension arms
36*a*—pivot axes of tension arms
66 slots in back plate
40—box
42—shaft
44—guide rollers
46—containment rollers
48—support
50—gear
52—rack
54—compression spring
56—spring retainer
58—adjustment screw
60—spring housing
62—lock nut
64—rods
A—A axis of rotation of coil support

DETAILED DESCRIPTION OF THE INVENTION

Figure 1:
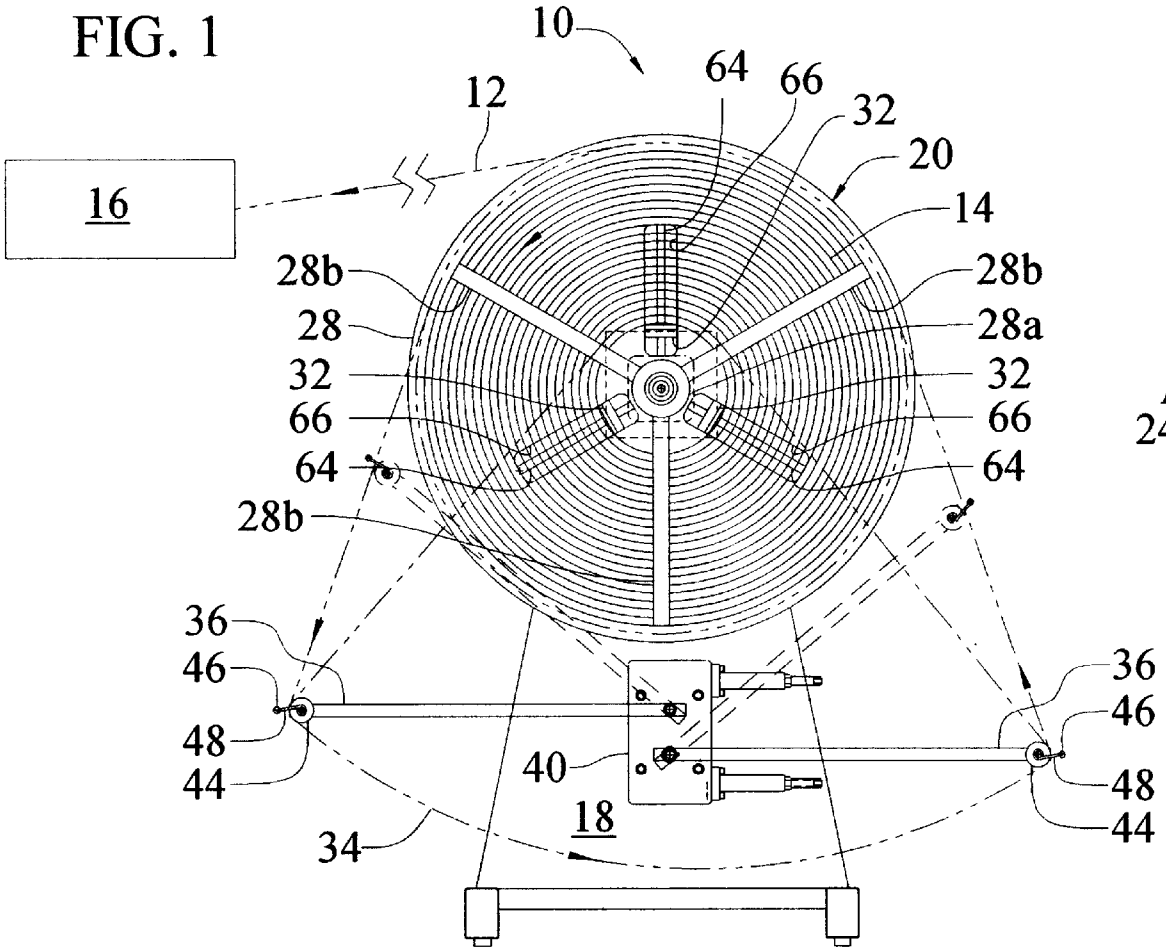
FIG. 1 is a side elevation view of a payoff reel incorporating the unique aspects of the present invention.

For purposes of illustration, the present invention is shown in the drawings as floor-standing reel 10 (FIGS. 1–2) adapted to payoff flexible strip stock 12 from a coil 14 of stock to a using station 16, such as a feed mechanism to a punch press, having an inlet positioned for receiving stock from the upper portion of the coil.

The reel 10 shown is a non-powered reel, and includes a frame support structure 18 extending upwardly from the floor, a coil support 20 that is carried on shaft 22 journaled in the upper portion of the frame for rotation about horizontal axis A—A, and a handle 24 connected to the shaft 22 for manual rotation of the coil support and manual payoff of stock from the coil such as during the initial setup of the using station. The coil support 20 shown includes a back plate 26, a light-weight front ring 28 provided with a center hub 28*a* and radially extending ring supports 28*b* therebetween, and coil guides 32 that extend from the back plate to the front ring for receiving and supporting both spooled and non-spooled coils of strip stock. The front ring is removably secured to the shaft 22 such as with threaded cap 30 for installation and removal of the coil from the coil guides. In this instance, the coil guides are slidably or otherwise carried on radially extending rods 64 that are connected to the back of the back plate and extend from the rods through slots 66 formed in the back plate. This permits radial positioning of the coil guides as required to snugly support the center of the coil. The handle 24 may alternately, or in addition, be connected to threaded guide rods 64 for adjusting the position of the coil guides.

In accordance with the present invention, the reel 10 is uniquely adapted to establish a loop 34 of stock that is smoothly responsive to the difference between the supply characteristics of the rotating coil support 20 and the intermittent draw characteristics of the using station 16, and that is generally within the floor-space footprint of the reel. More particularly, the reel is provided with stock guides that are cooperative to establish a draw-responsive variable-size loop 34 of stock generally encircling the coil 14 between the point of payoff from the coil and the point of exiting the reel for advancing to the using station such that the integral loop of stock eliminates the need for the floor space required to establish the loop of material associated with the use of conventional payoff reels.

In carrying out the invention, the reel 10 includes a pair of tension arms 36 that are provided with guides 44 laterally aligned with the coil 14 (see FIG. 2) and positioned to guide the stock 12 away from the coil after payoff, around approximately 180 degrees of the coil radially spaced therefrom, and then back past the coil support to exit the reel to the using station 16. The tension arms are pivotally mounted to the frame 18 for swinging of the guides toward and away from the coil, and are spring biased in the direction away from the coil, to establish a loop around the coil and the guides that is responsive to the differences between the draw characteristics of the using station and the rotating coil support.

In the embodiment shown, the tension arms 36 extend from centrally below the coil support 20 in opposite upstream and downstream directions in mirrored fashion, to opposite sides of the coil 14 in adjacent lower quadrants opposite the payoff side of the coil. The tension arms are mounted to shafts 42 which are journaled in the frame for swinging of the guides about horizontal axes 36*a*, through a plane that extends perpendicular to the axis of rotation A—A of the coil support to maintain alignment therewith, between the solid and dashed line positions shown in FIG. 1, and are biased to the solid-line position in the direction away from the coil. Alternately, for example, the tension arms may be mounted for swinging about the same axis such as by positioning the associated ends of the tension arms on the axis in stacked relation. The guides are provided in the form of rollers 44 mounted to the free ends of the tension arms 36 for free rotation about axes extending horizontal and parallel to the axis of rotation A—A of the coil support. This provides for low-friction guiding and turning of the stock as it travels over the rollers. Containment rollers 46 are provided outwardly of the guide rollers on supports 48 that extend around the sides of the stock path. The containment rollers and the supports 48 cooperate to prevent the stock from inadvertently slipping off the guide rollers as the tension arms respond to a change in material draw condition from the using station.

With this arrangement, the guide rollers 44 establish a stock path that progresses from a payoff point in the upper downstream quadrant on the coil generally toward the floor, turns toward the upstream direction around the first guide roller, circles around below the coil 14 to the second guide roller, turns up around the second guide and back toward the coil, and then onto the upper portion of the coil to feed downstream to the using station from the top of the coil. As the using station draws stock, the strip stock pays-off and follows this looped path below the coil, slidably engaging the outer coil of stock as it travels along the upper portion of the coil and on to the using station. Advantageously, the coil itself provides a third stock-guide location, without the need to provide a separate third guide, for turning the stock and establishing a path that extends through four quadrants (i.e., through an included angle greater than 270 degrees) between payoff from the coil and exiting to the using station.

Figure 5:
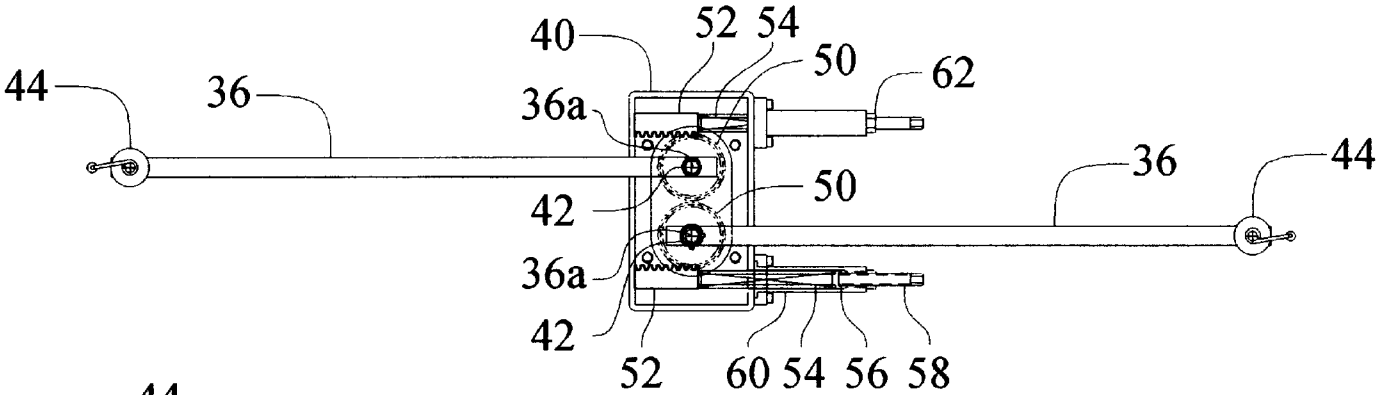
FIG. 5 is an enlarged view showing certain components spring-biasing the tension arms to their outward positions.
Figure 6:
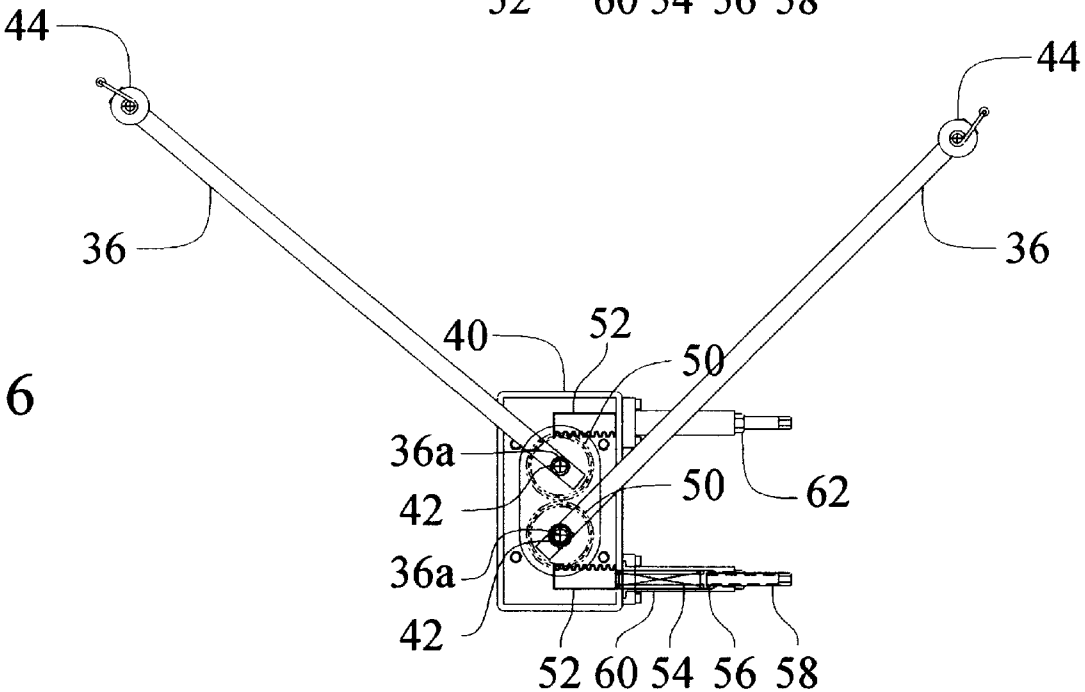
FIG. 6 is a view similar to FIG. 5 but showing said components and the tension arms drawn inwardly toward the coil as the size of the loop decreases during material draw by the using station.

As shown in detail in FIGS. 5 and 6, biasing of the tension arms 36 and the guide rollers 44 to their outer positions is provided through a rack and pinion arrangement. In this instance, gears 50 are mounted in a box 40 coaxial with the pivot axes 36*a* to shafts 42 extending therethrough. The gears 50 drivingly mesh with racks 52 that are carried in the box 40 for linear movement between extreme positions associated with the swinging range of the tension arms. Compression springs 54 positioned in spring housings 60 between the racks and spring retainers 56 bias the racks to the left as shown to bias the tension arms away from the coil. Screws 58 threaded into the free ends of the spring housings 60 rotatably engage the spring retainers and permit adjustment of the spring bias force by turning the screws. Lock nuts 62 lock the adjustment screws 58 into position after the spring bias has been adjusted as desired.

Figure 3:
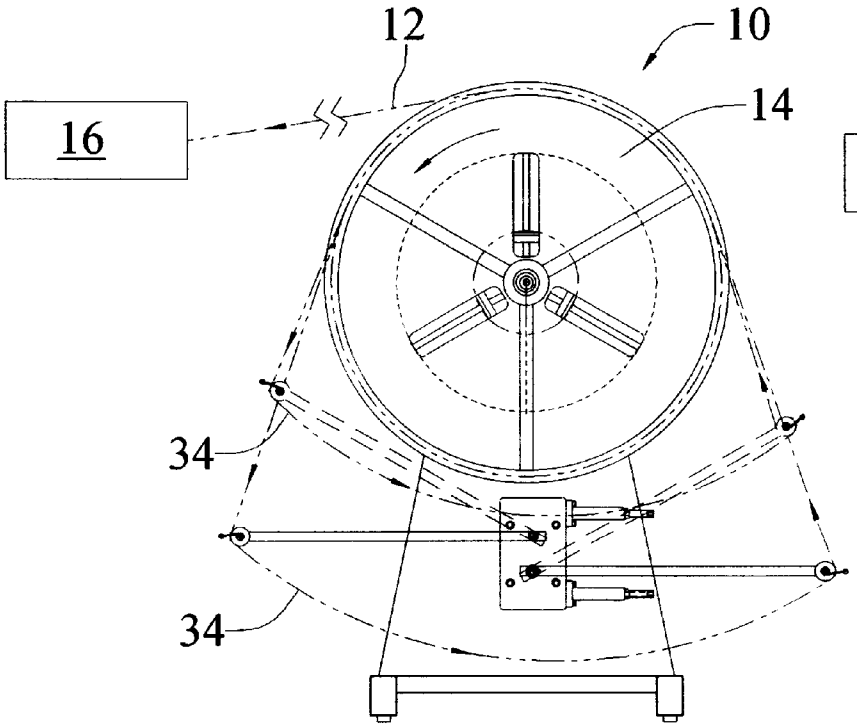
FIG. 3 is a view similar to FIG. 1 showing a change to the loop during payoff from a new coil, and associated movement of the tension arms and stock guides in dashed lines.

During each incremental material draw by the using station 16, the tension arms 36 respond and temporarily swing toward the coil 14 such as to the positions shown in dashed lines in FIG. 3 to allow the size of the loop to temporarily decrease. The rotating coil support 20 then resupplies stock 12 to the loop 34 for return of the tension arms to their biased positions (shown in solid lines) and return of the loop to its associated size. Advantageously, the spring bias acting on the tension arms provides a pulling force on the upstream portion of the loop 34 to assist in rotating the non-powered coil support and smoothly payoff additional stock until the arms return to their biased positions, with the tension and rate of the springs w being selected to achieve a desired dynamic response to the intermittent draw by the using station.

Figure 4:
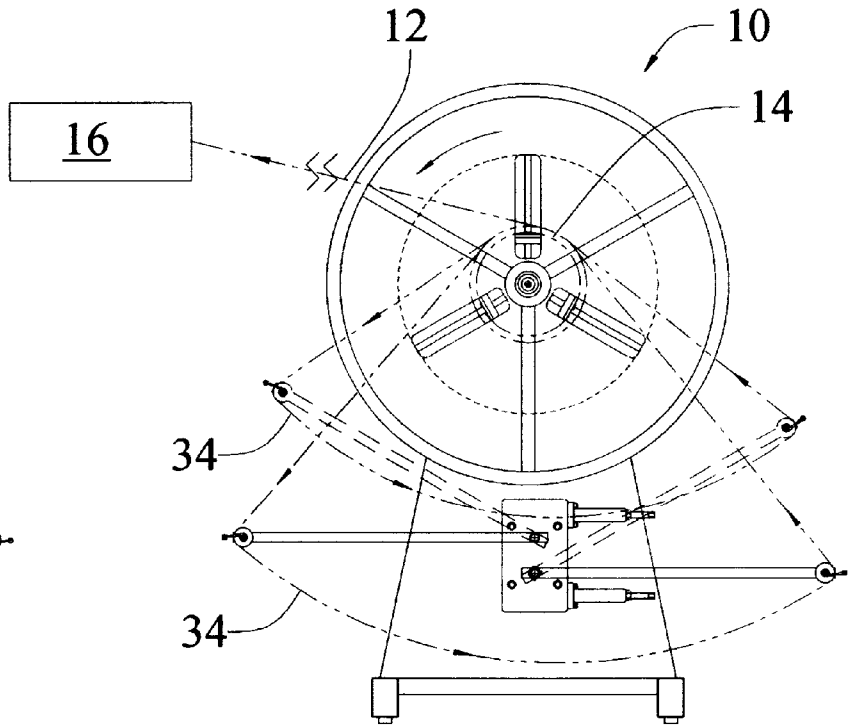
FIG. 4 is a view similar to FIG. 3 showing a change to the loop during payoff from an almost depleted coil, and associated movement of the tension arms and stock guides in dashed lines.

As further illustration of the operation of the reel 10, the stock feed path established by the guide rollers 44 for a new coil 14 is shown in FIG. 3, and the stock path established by the guide rollers for an almost depleted coil is shown in FIG. 4. As can be seen by comparing these paths, the tension arms and guide rollers maintain a draw-responsive loop 34 of stock through use of the entire coil. In this instance, the stock pays-off the reel in a first quadrant, circles around the reel through the second and third quadrants, and than re-engages the stock on the reel in the fourth quadrant to travel to the using station throughout use of the entire coil.

Those skilled in the art will appreciate that the reel 10 shown in the drawings may be provided in alternate embodiments while remaining within the scope of the present invention. For example, the tension arms and guide rollers may be biased with gravity or an alternate mechanical or fluidic arrangement such as with a coil spring or a pneumatic spring. Suitable alternate tension arm and/or guide arrangements adapted to create a draw-responsive variable-sized loop in accordance herewith will be readily devised by those skilled in the art, including but not limited to positioning the tension arms and guides above the coil support for payoff from the bottom of the coil, and positioning the guides in adjacent quadrants on the upstream side of the coil. However, the disadvantages of implementing such arrangements is the additional frame support that is required, and/or the additional tension arm length and complexity that will be required. And although the payoff reel 10 shown and described is a non-powered payoff reel, it will be apparent that the present invention is equally suitable for use with a power-rotated reel, either as a payoff reel or as a re-wind reel in the exit line from the using station. In this instance, one of the tension arms is preferably operatively connected to interact with a motor speed controller to control the speed of rotation of the coil support such as with a conventional speed-control dancer arm arrangement.

From the foregoing, it will be apparent that the present invention brings to the art a new and improved reel which, by virtue of establishing and guiding the stock in a draw-responsive variable-sized loop around the coil, provides for a smooth payout of stock as compared with from a conventional unguided loop of stock, and eliminates the need for additional floor space associated with the use of conventional reels of the same general type.

I claim:

1. A reel for supplying strip stock from a coil of stock to a downstream using station, the reel comprising:

a frame;

a coil support journaled in the frame for rotation about a horizontal axis, the coil support being adapted to carry the coil of stock rotatably about said horizontal axis; and first and second guides (i) connected to the frame for swinging toward and away from the coil support, and (ii) biased in said direction away from the coil support;

said guides being positioned to guide the stock along a variable-sized loop extending around said horizontal axis between payoff from the coil and exiting to the using station.

2. The reel as defined in claim 1 in which the guides are cooperative to establish said loop slidably contacting the coil prior to exiting to the using station.

3. The reel as defined in claim 1 in which said guides are connected for swinging in said directions toward and away from the coil support in a plane perpendicular to said horizontal axis.

4. A reel for supplying strip stock from a coil of stock to a downstream using station, the reel comprising:

a frame;

a coil support journaled in the frame for rotation about a horizontal axis, the coil support being adapted to carry the coil of stock rotatably about said horizontal axis; and first and second guides (i) connected to the frame for moving toward and away from the coil support, and (ii) positioned in adjacent first upstream and first downstream quadrants, respectively, with respect to said coil support;

said guides being positioned to guide the stock along a variable-sized loop substantially encircling the coil support between payoff from the coil in a second downstream quadrant to a second upstream quadrant adjacent thereto prior to exiting to the using station.

5. The reel as defined in claim 4 in which said guides are cooperative to establish said loop slidably contacting the coil in said second upstream quadrant prior to exiting to the using station.

6. The reel as defined in claim 4 in which the guides are positioned below the coil support in said first upstream and first downstream quadrants.

7. The reel as defined in claim 4 in which said guides are (i) connected for moving in said directions toward and away from the coil support in a plane perpendicular to said horizontal axis, and (ii) biased downwardly in said direction away from the coil support.

8. A reel for supplying strip stock from a coil of stock to a downstream using station, the reel comprising:

a frame;

a coil support journaled in the frame for rotation about a horizontal axis, the coil support being adapted to carry the coil of stock rotatably about said horizontal axis; and first and second tension arms journaled in the frame for swinging toward and away from the coil support, the tension arms being biased in said direction away from the coil support; and first and second guides (i) aligned with the coil support and (ii) connected to the first and second tension arms, respectively, for swinging toward and away from the coil support therewith;

said guides being positioned to guide the stock along a variable-sized loop substantially encircling the coil support between payoff from the coil and exiting to the using station.

9. The reel as defined in claim 8 in which the first and second guides are positioned in adjacent first upstream and first downstream quadrants, respectively, and are cooperative to establish said loop between payoff from a second downstream quadrant of the coil through a second upstream quadrant adjacent thereto.

10. The reel as defined in claim 9 in which said first and second tension arms are journaled in the frame below the coil support for swinging upwardly toward and downwardly away from the coil support, the tension arms extending generally upstream and downstream therefrom and being biased in said direction downwardly away from the coil support.

11. The reel as defined in claim 9 in which said guides are cooperative to establish said loop slidably contacting the coil in said second upstream quadrant prior to exiting to the using station.

12. A method for supplying strip stock from a coil of stock to a downstream using station, the method comprising the steps of:

(A) providing:

(i) a coil support journaled for rotation about a first horizontal axis, the coil support being adapted to carry the coil of stock rotatably about said horizontal axis, and (ii) first and second guides positioned in adjacent first upstream and first downstream quadrants, respectively, with respect to the coil support; and (B) establishing a variable-sized loop of stock around the guides and substantially encircling the coil support between payoff from the coil in a second downstream quadrant through a second upstream quadrant adjacent thereto prior to exiting to the using station; the size of the loop and the position of the guides being responsive to the differences in the supply characteristics of the coil support and the draw characteristics of the using station.

13. The method as defined in claim 12 in which said guides and said variable sized loop are aligned with the coil support.

14. The method as defined in claim 12 in which said guides are positioned in said adjacent quadrants below the coil support.

* * * * *